United States Patent [19]

Peckham

[11] 3,990,909

[45] Nov. 9, 1976

[54] SYSTEM FOR FLUSHING BLIND CAVITIES

[75] Inventor: Robert O. Peckham, Loudonville, N.Y.

[73] Assignee: The United States of America, Washington, D.C.

[22] Filed: Aug. 8, 1975

[21] Appl. No.: 603,211

[52] U.S. Cl. ..... 134/168 R; 134/169 A

[51] Int. Cl.[2] ..... B08B 3/02; B08B 9/00

[58] Field of Search ..... 134/166 R, 167 R, 168 R, 134/169 R, 169 A, 24

[56] References Cited

UNITED STATES PATENTS

| | | | |
|---|---|---|---|
| 1,552,998 | 9/1925 | Menge | 134/168 R X |
| 2,240,227 | 4/1941 | Saussure | 134/168 R |
| 3,003,506 | 10/1961 | Wosicki | 134/167 R X |
| 3,843,408 | 10/1974 | Tobin | 134/24 |

*Primary Examiner*—Robert L. Bleutge

*Attorney, Agent, or Firm*—Nathan Edelberg; Robert P. Gibson; Harold H. Card, Jr.

[57] ABSTRACT

A blind cavity is thoroughly flushed free of foreign matter by apparatus for pumping hydraulic oil up through a tube of lesser diameter than the access opening to the cavity and returning the exit flow of the contaminated fluid to the pump through a coaxial bore surrounding the tube and of larger diameter than both the access opening and the tube.

2 Claims, 1 Drawing Figure

12
14
16
18
20
20
42
44
40
56
62
38
22
30
31
36
33
26
34
24
33
32
46
56
48
49
50
62
60
52
53
P
54
66

SYSTEM FOR FLUSHING BLIND CAVITIES

The invention described herein may be manufactured, used, and licensed by or for the Government for Governmental purposes without the payment to me of any royalties thereon.

BACKGROUND OF THE INVENTION

This invention relates to the removal of contaminants from a blind cavity and is more particularly directed to a flushing system for effecting an unimpeded circulation of fluid throughout the cavity.

The rapid and complete cleansing of a blind cavity presents a relatively difficult problem where the width of the access opening thereto is substantially smaller than the maximum width along the interior thereof. Such problem is even further complicated where the cavity has been machined into a metal component since the heat generated thereby frequently reaches the point at which the chips become lightly welded to the wall surfaces of the cavity. As a result, the simple flushing of the cavity with a continuous flow of fluid under pressure ordinarily fails to produce the high degree of cleanliness required when such cavity is incorporated in a hydraulic drive motor. For one thing, the volume of fluid which can be introduced into the access opening is limited by a need for a continuous and simultaneous exit flow therefrom. Furthermore, the pressure which can be imparted to the entrance flow of fluid is also limited by the need for avoiding the degree of turbulence which would interfere with the desired continuity of the exit flow from the access opening.

SUMMARY OF THE INVENTION

Accordingly, it is an object of this invention to provide a system for flushing a blind cavity so as to avoid any interference between the simultaneous entrance and exit flow of fluid therefrom.

A further object of this invention resides in the provision of a flushing system, as aforesaid, wherein the pressure of the entrance flow of the fluid can be readily increased to ensure the complete removal of all the foreign matter in a blind cavity without a corresponding decrease in flushing efficiency.

It is another object of the present invention to provide a flushing system, as aforesaid, wherein the connection thereof to the blind cavity can be readily adjusted to accomodate access openings of different size and yet seal against any loss of fluid therefrom.

It has been found that the foregoing objects can be achieved by a flushing system comprising a plurality of components adjustably threaded into vertical end-to-end relation to form a continuous central bore therethrough in sealed communication with the access opening of the cavity to be flushed. A length of tubing of lesser diameter than the central bore extends upwardly therethrough into the interior of the blind cavity to supply a pressurized flow of hydraulic oil thereto from a suitable circulating pump. Vertical adjustment of the uppermost component of the system serves to seat a compressible washer or gasket thereon against the underside of the access opening in the blind cavity to seal against leakage of the exit flow of fluid into the central bore. The rapid circulation of fluid within the blind cavity loosens any foreign matter adhering to the walls thereof which together with the rest of the contaminents is then flushed out of the access opening into the central bore surrounding the tubing to return to the circulating pump for filtering and reuse.

BRIEF DESCRIPTION OF THE DRAWINGS

The exact nature of the invention as well as other objects and advantages thereof will be readily apparent from consideration of the following specification relating to the annexed drawing, wherein.

DESCRIPTION OF A PREFERRED EMBODIMENT

Figure 1:
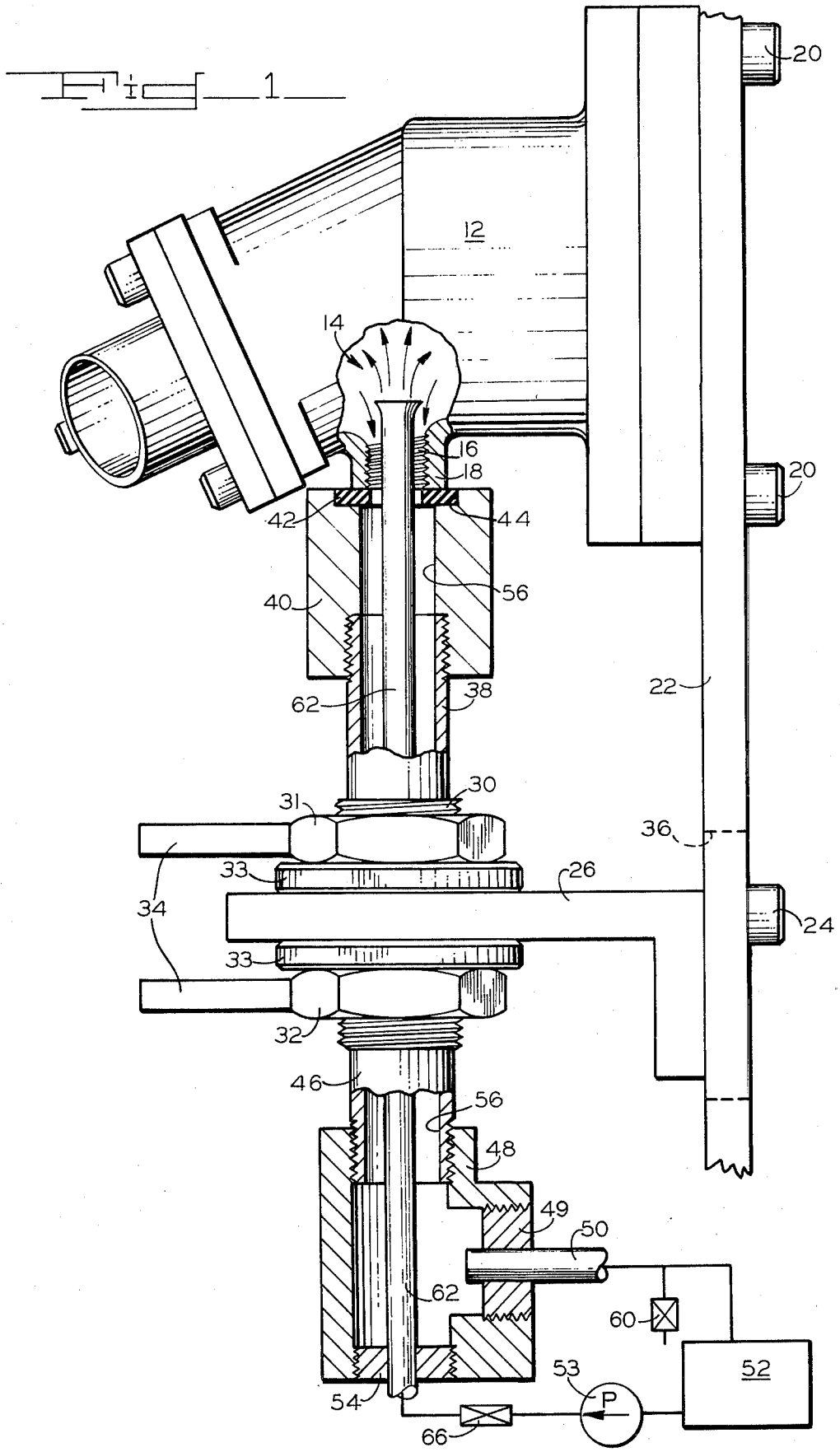
FIG. 1 is a vertical section showing the arrangement of the component parts of the flushing system with a portion of the cavity to be flushed cut away to show the extent to which the supply tube for the hydraulic oil is inserted therein.

While the flushing apparatus of the invention is designed for use with any item having a blind cavity adapted to be cleaned by a flow of pressurized oil, it is particularly useful where the item is a hydraulic drive motor 12 which can be tested for proper operation by the same flow of hydraulic oil utilized to flush the various contaminants introduced therein during the machining thereof. The interior of motor 12 includes a blind cavity 14 of greater transverse width than the hollow interior 16 of the cylindrical fitting 18 which provides access to cavity 14. In order to be properly flushed, motor 12 is secured, as by bolts 20, to the upper end of a supporting stand 22 with fitting 18 positioned to open in a downward direction.

A support bracket 26 is bolted, as indicated at 24, to mounting stand 22 in spaced vertical relation to fitting 18 and is provided with a U-shaped portion (not shown) surrounding the threaded exterior of an adjusting member 30. Suitable nuts 31, 32 are threaded onto adjusting member 30 in position to contact spacing washers 33 on opposite sides of bracket 26 and are each provided with actuating handles 34. When nut 32 is loosened, clockwise rotation of nut 31 raises member 30 relative to drive motor 12 while loosening of nut 31 and subsequent clockwise rotation of nut 32 produces a corresponding lowering of member 30. Since bolt 24 passes through a vertical slot 36 in stand 22, support bracket 26 can also be correspondingly adjusted to impart additional vertical movement to member 30.

The upper end of member 30 is extended, as indicated at 38, into threadable engagement with the lower end of a cylindrical adapter 40 provided with a sealing gasket or washer 42 seated in a corresponding recess 44 in the opposite end thereof. Thus, vertical adjustment of member 30 or bracket 26, or both, will bring washer 42 into sealing contact with the underside of fitting 18.

The lower end of adjusting member 30 is similarly extended, as indicated at 46, into threadable engagement with a closure member 48, suitably connected as indicated at 49, to a conduit 50 leading to a supply tank 52 from which hydraulic oil is circulated by a suitable pump 53. The underside of closure member 48 is provided with a sealing plug 54.

Adapter 40 and members 30 and 48 are drilled to provide a continuous bore 56 therethrough of slightly greater diameter than the hollow interior 16 of fitting 18. The lower end of bore 56 terminates within closure member 48 in direct communication with conduit 50. At some suitable point downstream of supply tank 52, conduit 50 is provided with a check valve 60 to permit the taking of a sample of the oil flow for testing the degree of contamination thereof.

A supply tube 62 of lesser diameter than continuous bore 56 extends upwardly through sealing plug 54 to terminate within blind cavity 14 at a point above hollow interior 16 of fitting 18. The opposite end of tube 62 is connected to pump 53 which is normally operated at a nominal pressure of 25 psi. However, it is also intended that oil be pumped into drive motor 12 at a pressure sufficient to test the operability thereof. This may be readily accomplished by a regulating valve 66 which will control the flow pressure in increments up to a maximum of 1000 psi. In the event a pressure greater than 1000 psi is desired, regulating valve 66 can be arranged to by-pass tube 62 and direct the test flow of hydraulic oil directly to drive motor 12. Where the interior diameter of fitting 18 measures 7/16 inch, the continuous bore 56 through the system is preferably formed with a 5/8 inch diameter while supply tube 62 is provided with a 1/4 inch opening.

Thus, there is here provided a relatively simple and efficient system for thoroughly flushing the interior of a blind cavity to remove any foreign material therefrom either loose or adherent to the wall surfaces thereof. The component parts of the system can be readily adjusted to maintain a desired sealing contact regardless of variations in the size of the access opening to the blind cavity. In addition, the system can be employed without change to either flush a blind cavity or test the item containing the cavity for proper hydraulic function.

I claim:

1. A system for flushing the interior of a blind cavity in a hydraulic drive motor, comprising:

a cylindrical projection depending from the drive motor to form an access opening of lesser width than that of the blind cavity;

an externally threaded intermediate member having a central bore therethrough of greater diameter than the width of the blind cavity;

an adapter having a washer in one end thereof and secured at the other end thereof to said intermediate member for continuing said central bore thereof, a closure member secured to said intermediate member at the end thereof remote from said adapter;

an exit conduit in said closure member in communication with said central bore of said intermediate member;

adjustable support means depending from the drive motor for locating said central bore of said intermediate member in vertical alignment with said access opening in said cylindrical projection;

a pair of adjusting nuts engageable with said threaded exterior of said intermediate member for vertically positioning said adapter to bring said washer into sealing abutment with said cylindrical projection on the drive motor;

a tube of smaller diameter than said central bore of said intermediate member extending through said closure member to terminate within the interior of the blind cavity to be flushed; and a pump for circulating a continuous flow of hydraulic oil through said tube into the blind cavity and out therefrom back through said central bore and said exit conduit.

2. The system defined in claim 1 wherein said adjustable support means includes:

a vertical stand secured to the drive motor;

a support bracket secured to said stand, said bracket having a U-shaped portion straddling said intermediate member between said adjusting nuts; and means for vertically adjusting said bracket to position said adapter in adjacent relation to said cylindrical projection.

* * * * *